US007839250B2

(12) United States Patent
Ger et al.

(10) Patent No.: US 7,839,250 B2
(45) Date of Patent: Nov. 23, 2010

(54) TRANSFORMER WITH LEAKAGE INDUCTANCE

(75) Inventors: Chih-Chan Ger, Jhongli (TW); Chia-Kun Chen, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 12/463,415

(22) Filed: May 10, 2009

(65) Prior Publication Data

US 2010/0079231 A1 Apr. 1, 2010

(30) Foreign Application Priority Data

Sep. 26, 2008 (CN) ..... 2008 2 0212182

(51) Int. Cl.
*H01F 17/06* (2006.01)

(52) U.S. Cl. ..... 336/178

(58) Field of Classification Search ..... 336/65, 336/83, 178, 180–184, 212
See application file for complete search history.

(56) References Cited

U.S. PATENT DOCUMENTS

| | | | | |
|---|---|---|---|---|
| 7,221,252 | B1 | 5/2007 | Chang | |
| 7,271,694 | B2 * | 9/2007 | Chang | 336/208 |
| 7,528,694 | B2 * | 5/2009 | Tseng et al. | 336/212 |
| 2006/0181384 | A1 * | 8/2006 | Hsueh et al. | 336/122 |
| 2007/0159288 | A1 * | 7/2007 | Chang | 336/212 |
| 2008/0211615 | A1 * | 9/2008 | Ushijima et al. | 336/170 |

* cited by examiner

*Primary Examiner*—Tuyen Nguyen
(74) *Attorney, Agent, or Firm*—Raymond J. Chew

(57) ABSTRACT

A transformer includes a bobbin and a core assembly. The bobbin includes a pair of first winding portions to wrap primary winding coils thereon and a second winding portion between the pair of first winding portions to wrap secondary winding coils thereon. The core assembly includes a first core and a second core. At least one gap is formed between the first core and the second core at opposite sides of the second winding portion to adjust leakage inductance of the transformer. The gaps and the winding coils of the second winding portion are positioned in a same magnetic circuit, the magnetic circuit generating the leakage inductance of the transformer.

15 Claims, 8 Drawing Sheets

TRANSFORMER WITH LEAKAGE INDUCTANCE

BACKGROUND

1. Technical Field

The present disclosure generally relates to transformers, and more particularly to a transformer with leakage inductance.

2. Description of Related Art

In an electronic device, one or more transformers are used for converting a received power signal to an appropriate signal to ensure proper transformer operation. A frequently used transformer has an adjustable leakage inductance to meet resonance requirements.

FIG. 8 is a schematic diagram of a commonly used transformer 300 with adjustable leakage inductance. The transformer 300 includes an I-shaped first core 310, a second core 320, a pair of second windings 340, and a first winding 330 between the pair of second windings 340. The first core 310 extends through the first winding 330 and the pair of second windings 340. The second core 320 includes a pair of first projections 322 each between each of the pair of second windings 340 and the first second winding 330, and a pair of second projections 324 located at opposite distal ends thereof. After assembly, the pair of second projections 324 abuts the first core 310. A pair of gaps 350, 360 are formed between the pair of first projections 322 and the first core 310, respectively so that a pair of magnetic circuits 370, 380 is formed between the pair of second windings 340 and the first second winding 330.

The transformer 300 can adjust leakage inductance by adjusting depth of the gaps 350, 360. However, the pair of second windings 340 is positioned in different magnetic circuits 370, 380, generating different leakage inductance of the pair of secondary windings 340 and circuit of the loads electrically connected to the pair of secondary windings 340.

Therefore, a need exists in the industry to overcome the described limitations.

DETAILED DESCRIPTION

Figure 1:
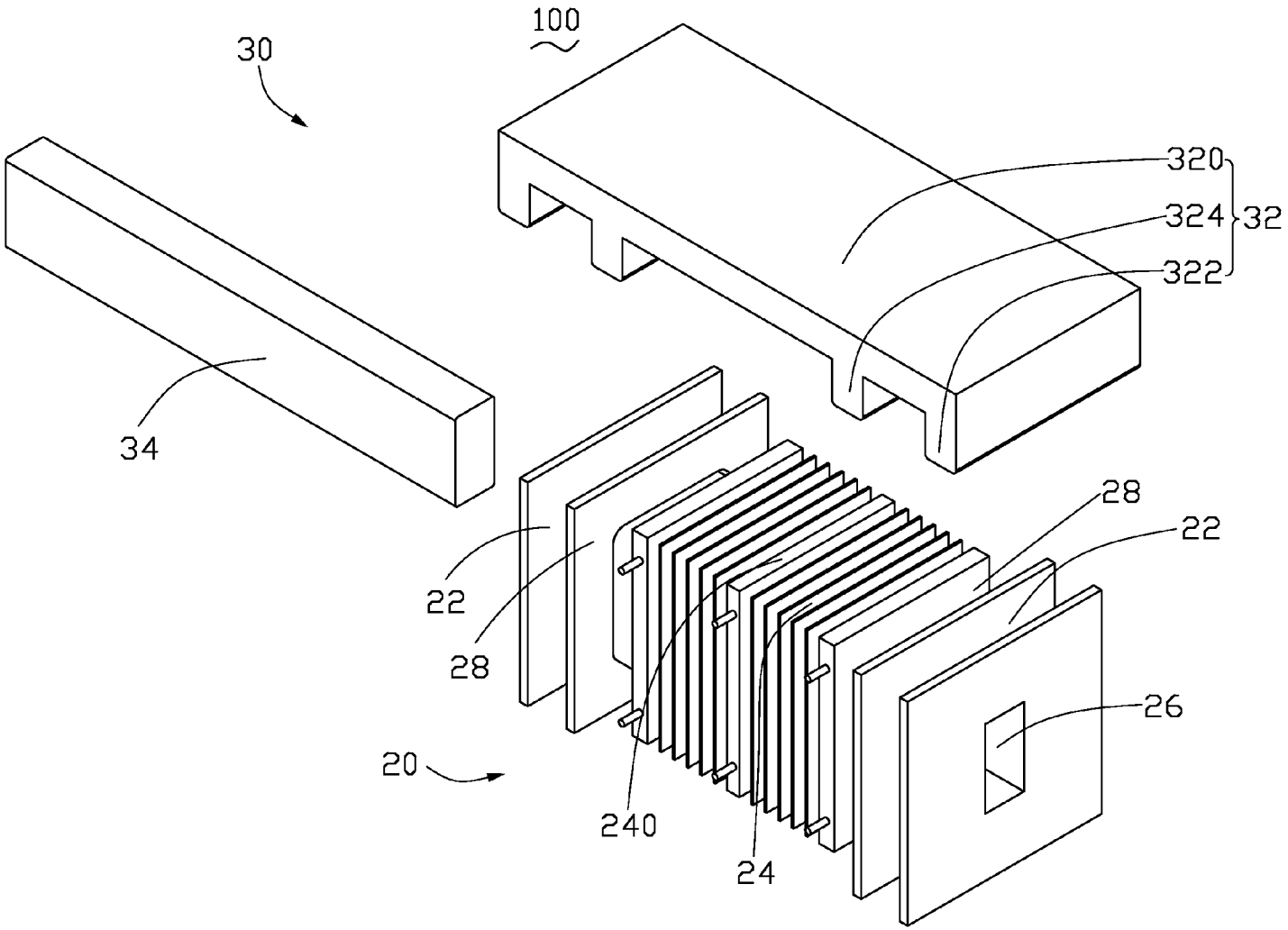
FIG. 1 is an exploded, isometric view of a first embodiment of a transformer of the disclosure.

FIG. 1 is an exploded, isometric view of a first embodiment of a transformer 100 of the disclosure. The transformer 100 includes a bobbin 20 and a core assembly 30.

The bobbin 20 includes a pair of first winding portions 22 to wrap primary winding coils (not shown) thereon, a second winding portion 24 to wrap secondary winding coils (not shown) thereon, and a receiving hole 26 extending through the pair of first winding portions 22 and the second winding portion 24. The second winding portion 24 is divided into two regions by a partition plate 240.

Alternatively, the second winding portion can be divided into n+1 regions by n partition plates 240, where n is an integer from 1 to n. In other words, the second winding portion may be divided into a plurality of regions to wrap a plurality of second winding coils thereon.

A pair of partition portions 28 is formed between each of the pair of first winding portions 22 and the second winding portion 24 so as to increase separation between each of the pair of first winding portions 22 and the second winding portion 24.

In the illustrated embodiment, the pair of first winding portions 22, the second winding portion 24, and the pair of partition portions 28 are integrally formed.

The core assembly 30 includes a first core 32 made of a manganese-zinc material and an I-shaped second core 34 made of a nickel-zinc material and received in the receiving hole 26. Conductive coefficient of the first core 32 is at least 100 times of that of the second core 34.

The first core 32 includes a main body 320, a pair of first projections 322 projecting from opposite distal ends of the main body 320, and a pair of second projections 324 received in the pair of partition portions 28 of the bobbin 20 and between the pair of first projections 322.

Alternatively the first core 32 can be U-shaped and include a pair of projections projecting from a middle portion thereof.

Figure 2:
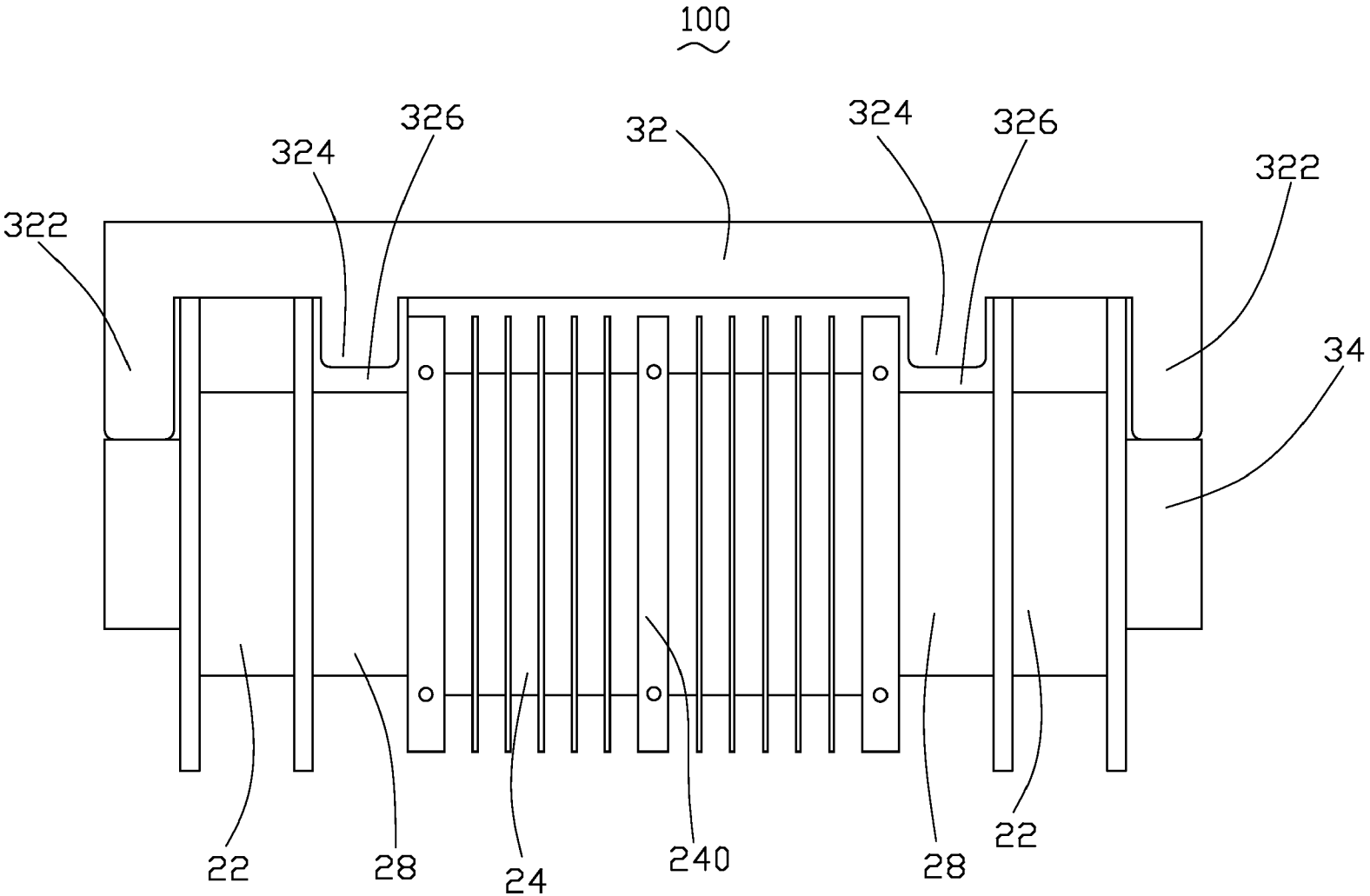
FIG. 2 is an assembled, plan view of FIG. 1.

FIG. 2 is an assembled, plan view of the transformer 100. After assembly, the pair of first projections 322 of the first core 32 abut the second core 34. Each of the pair of second projections 324 is received in a corresponding partition portion 28 and apart from the second core 34, such that a pair of gaps 326 is formed between the first core 32 and the second core 34 at the pair of second projections 324 to adjust leakage inductance of the transformer 100.

Figure 3:
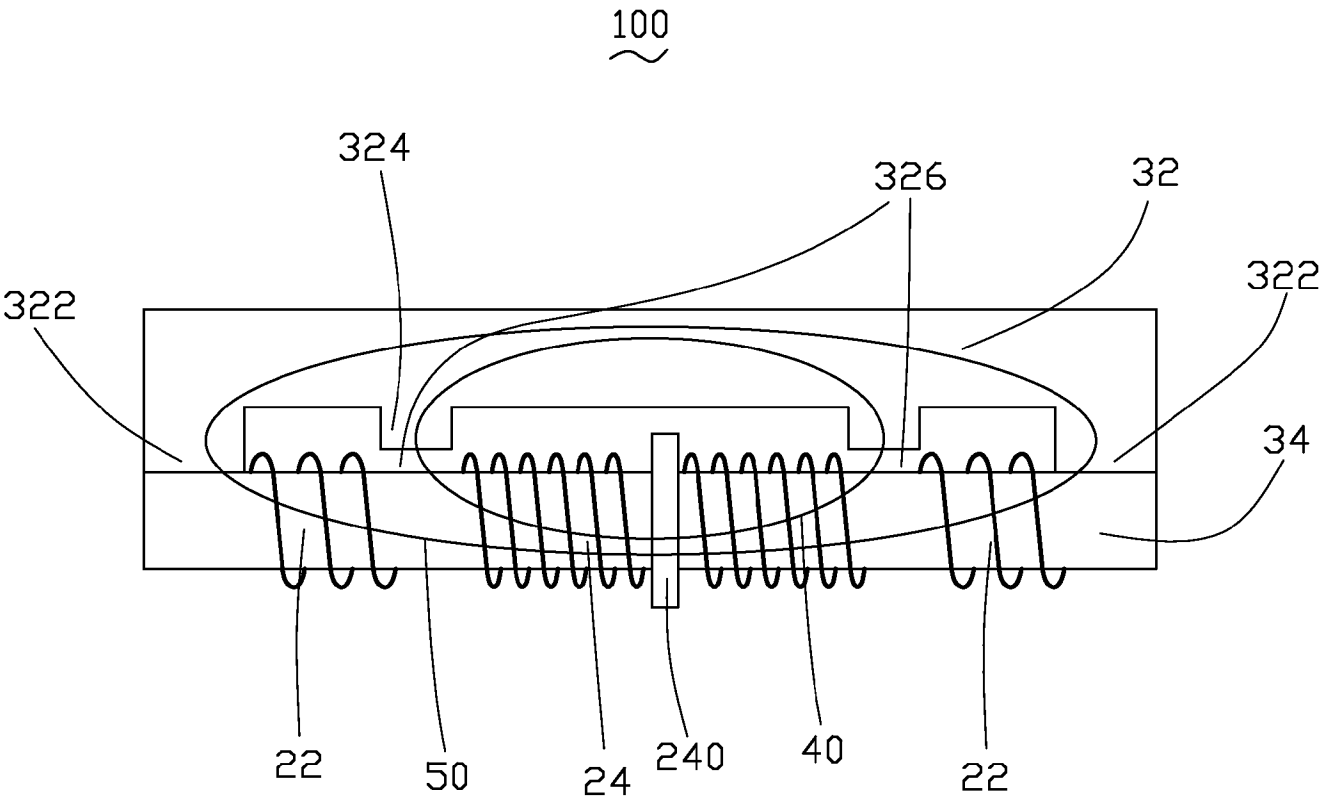
FIG. 3 is a schematic diagram of FIG. 2.

FIG. 3 is a schematic diagram of the transformer 100. The pair of second projections 324 of the first core 32, the pair of gaps 326, the second core 34, and the second winding portion 24 cooperatively form a magnetic circuit 40. The pair of first projections of the first core 322, the second core 34, the pair of first winding portions 22, and the second winding portion 24 cooperatively form a magnetic circuit 50. Because of the magnetic circuit 40, field lines in the magnetic circuit 50 reduce and magnetic field lines in the magnetic circuit 40 increase, thereby increasing leakage inductance of the second winding portion 24. In addition, the two secondary winding coils of the second winding portion 24 and the pair of gaps 326 are positioned in the same magnetic circuit 40, generating substantially the same leakage inductance as the two secondary winding coils of the second winding portion 24 and the circuit of the two loads electrically connected to the two secondary winding coils of the second winding portion 24.

Figure 4:
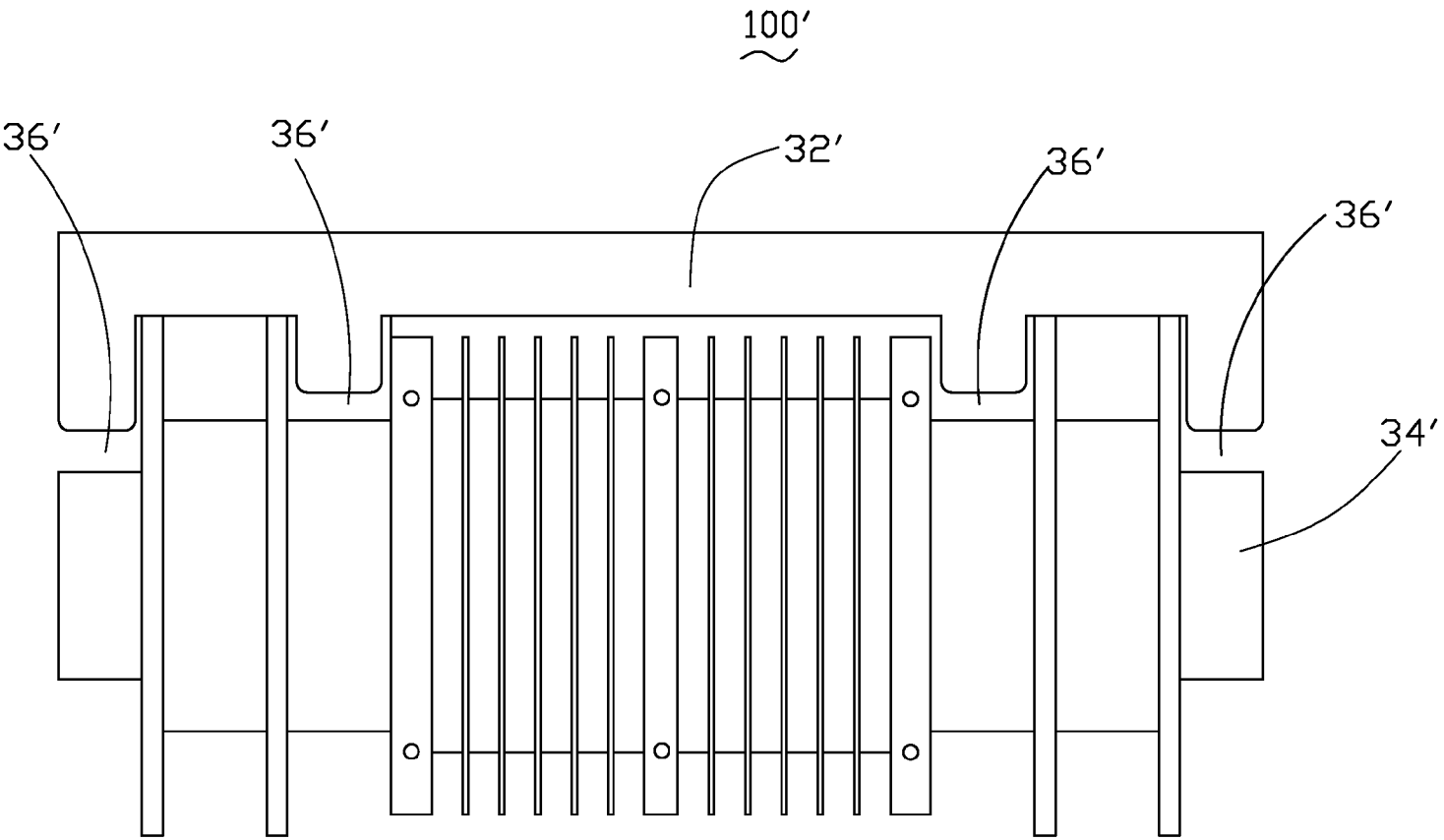
FIG. 4 is an assembled, plan view of a second embodiment of a transformer of the disclosure.

FIG. 4 is an assembled, plan view of a second embodiment of a transformer 100' of the disclosure, differing from transformer 100 shown in FIG. 1 only in that the transformer 100' defines two pairs of gaps 36' between the first core 32' and the second core 34'. The transformer 100' can substantially perform the same function as the transformer 100.

Figure 5:
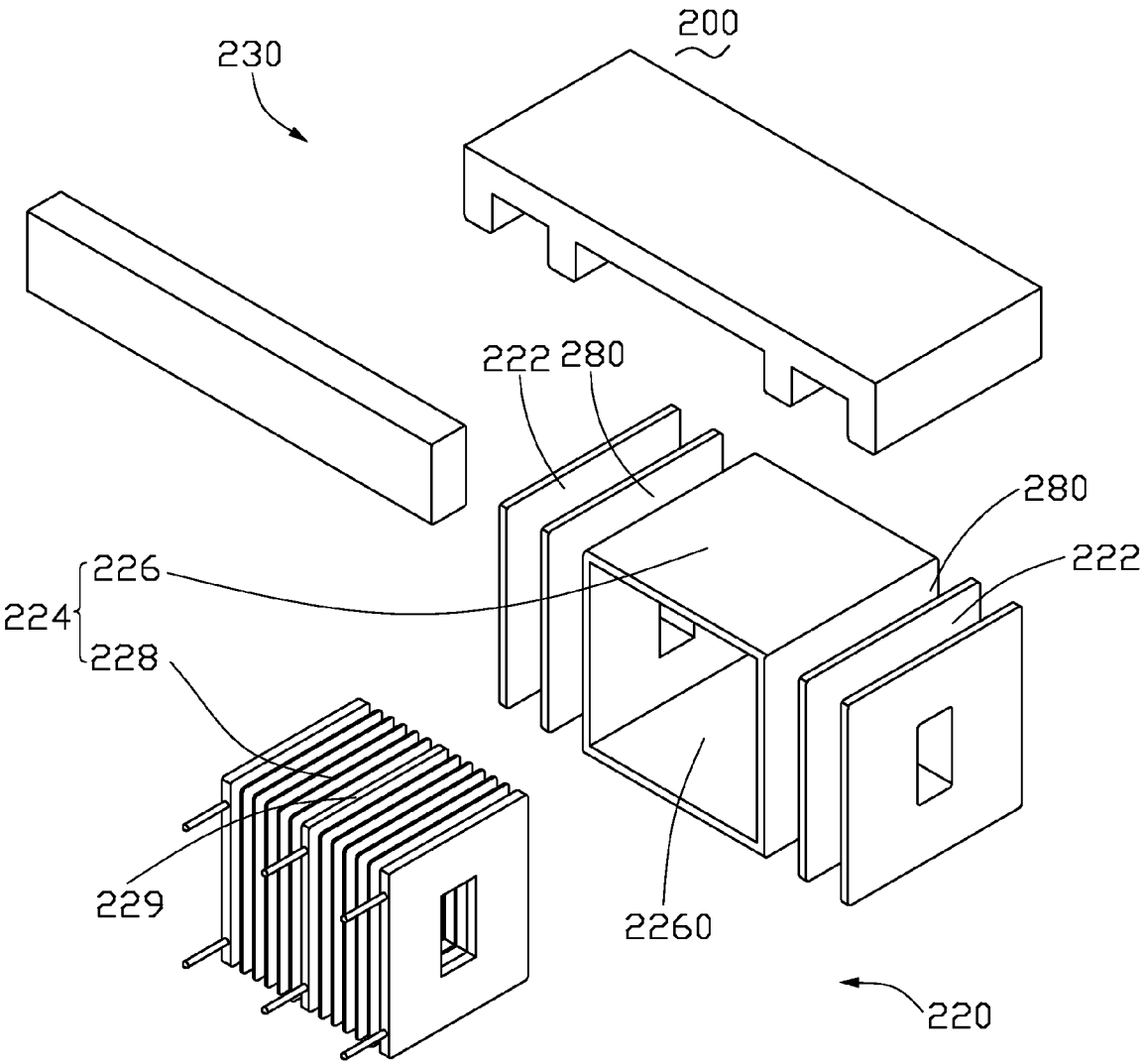
FIG. 5 is an exploded, isometric view of a third embodiment of a transformer of the disclosure.
Figure 6:
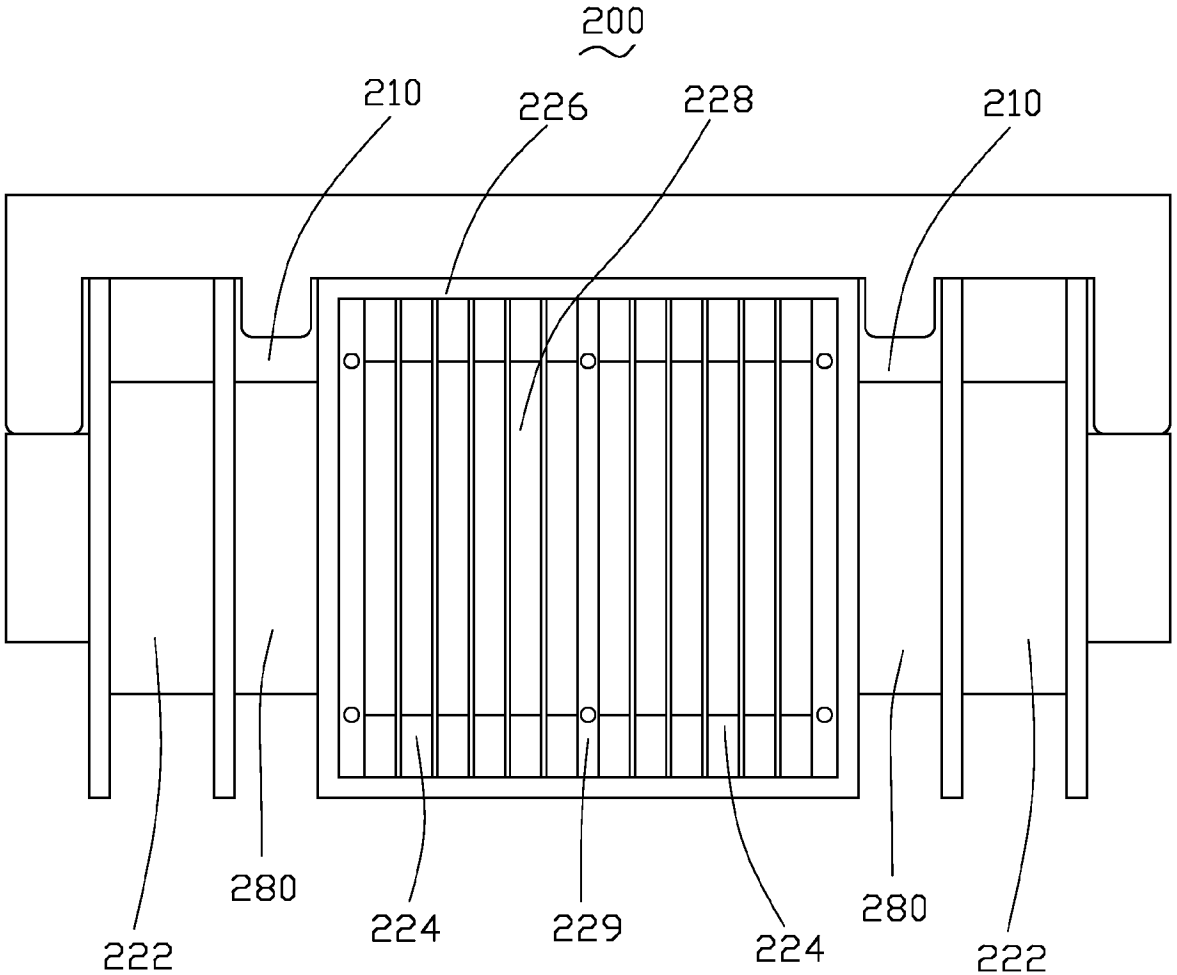
FIG. 6 is an assembled, plan view of FIG. 5.

FIG. 5 is an exploded, isometric view of a third embodiment of a transformer 200 of the disclosure. FIG. 6 is an assembled, plan view of the transformer 200. The transformer 200 includes a bobbin 220 and a core assembly 230.

The bobbin 220 differs from bobbin 20 shown in FIG. 1 only in that the bobbin 220 includes a pair of first winding portions 222, a second winding portion 224 including a winding chassis 226 and a winding frame 228 separated from and received in the winding chassis 226 and divided into two regions by a partition plate 229, and a pair of partition portions 280 between the pair of first winding portions 222 and the second winding portion 224. In the disclosure, the pair of first winding portions 222, the winding chassis 226 of the second winding portion 224, and the pair of partition portions 280 are integrally formed.

Alternatively the winding frame 228 can be divided into n+1 regions by n partition plates 229, where n is an integer from 1 to n. In other words, the winding frame 228 may be divided into a plurality of regions to wrap a plurality of second winding coils thereon.

Alternatively each of the pair of first winding portions may include a winding chassis and a winding frame separated from the winding chassis.

The core assembly 230 has similar structure and material to those of the core assembly 30 shown in FIG. 1. The transformer 200 can substantially perform the same function as the transformer 100 described above.

Figure 7:
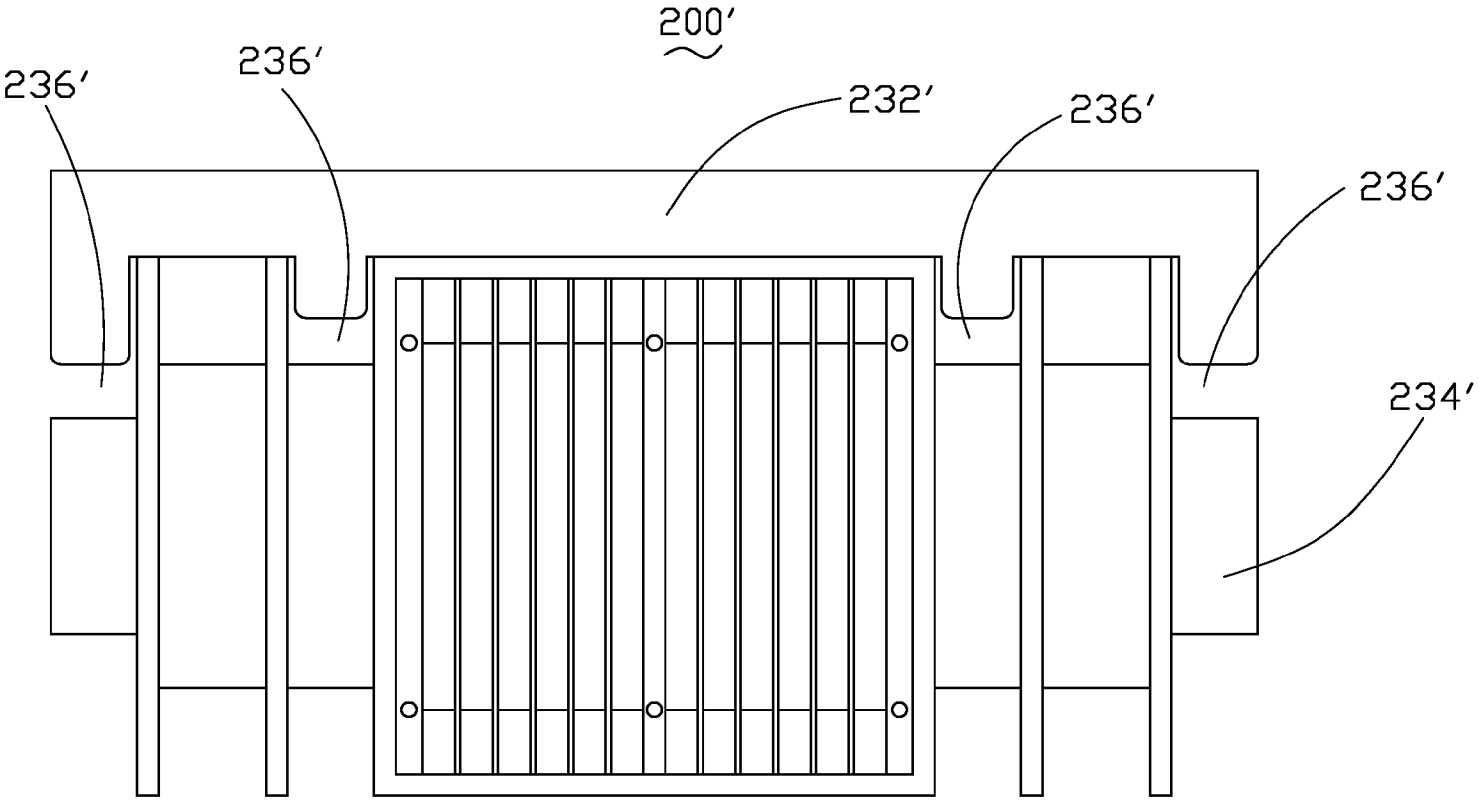
FIG. 7 is an assembled, plan view of a fourth embodiment of a transformer of the disclosure.
Figure 8:
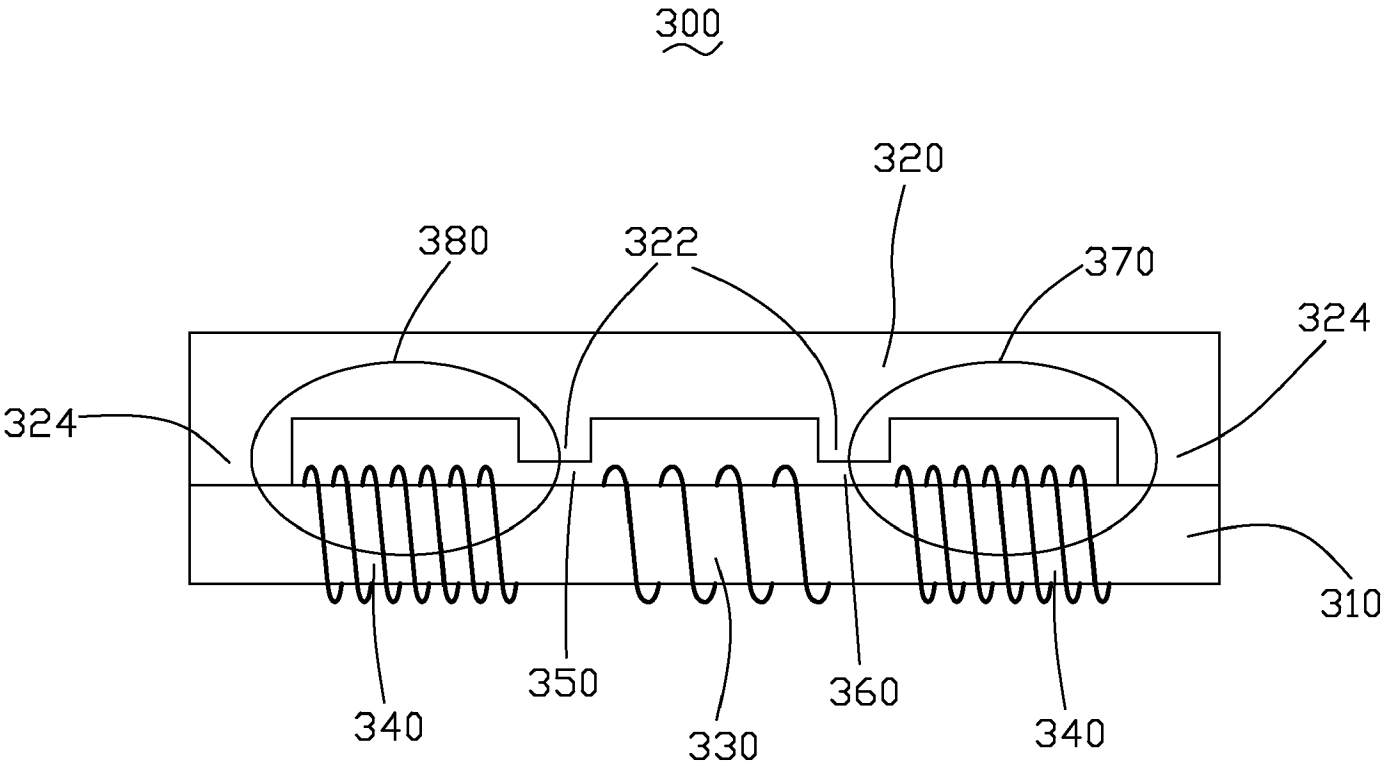
FIG. 8 (RELATED ART)
FIG. 8 is a schematic diagram of a commonly used transformer.

FIG. 7 is an assembled, plan view of a fourth embodiment of a transformer 200' of the disclosure, differing from transformer 200 shown in FIG. 5 in the definition of two pairs of gaps 236' between the first core 232' and the second core 234'. The transformer 200' can substantially perform the same function as the transformer 200 described above.

While embodiments of the present disclosure have been described, it should be understood that they have been presented by way of example only and not by way of limitation. Thus the breadth and scope of the present disclosure should not be limited by the above-described exemplary embodiments, but should be defined only in accordance with the following claims and their equivalents.

What is claimed is:

1. A transformer, comprising:

a bobbin comprising a pair of first winding portions to wrap primary winding coils thereon, and a second winding portion between the pair of first winding portions to wrap secondary winding coils thereon; and a core assembly comprising a first core and a second core, wherein at least one gap is formed between the first core and the second core at opposite sides of the second winding portion to adjust leakage inductance of the transformer;

wherein the gaps and the secondary winding coils of the second winding portion are positioned in a same magnetic circuit of the transformer, the magnetic circuit generating the leakage inductance of the transformer.

2. The transformer as recited in claim 1, wherein conductive coefficient of the first core is at least 100 times of that of the second core.

3. The transformer as recited in claim 2, wherein the first core is made of a manganese-zinc material and the second core is a made of nickel-zinc material.

4. The transformer as recited in claim 3, wherein the bobbin defines a receiving hole extending through the pair of first winding portion and the second winding portion to receive the second core.

5. The transformer as recited in claim 1, wherein the second winding portion of the bobbin is divided into a plurality of regions to wrap a plurality of second winding coils thereon.

6. The transformer as recited in claim 1, wherein the second winding portion of the bobbin comprises a winding chassis and a winding frame, wherein the winding frame is separated from the winding chassis and divided into a plurality of regions to wrap a plurality of second winding coils thereon.

7. The transformer as recited in claim 1, wherein each of the pair of first winding portions of the bobbin comprises a winding chassis and a winding frame separated from the winding chassis.

8. The transformer as recited in claim 1, wherein the bobbin comprises a pair of partition portions positioned between each of the pair of first winding portions and the second winding portion, wherein the first core comprises a pair of projections each received in a corresponding partition portion.

9. A transformer, comprising:

a bobbin comprising a pair of first winding portions to wrap primary winding coils thereon, a second winding portion between the pair of first winding portions to wrap secondary winding coils thereon, and a receiving hole extending through the pair of first winding portions and the second winding portion; and a core assembly comprising a first core comprising a pair of projections and a second core, wherein at least one gap is formed between the pair of projections of the first core and the second core at opposite sides of the second winding portion to adjust leakage inductance of the transformer;

wherein the gaps and the secondary winding coils of the second winding portion are positioned in a same magnetic circuit of the transformer, the magnetic circuit generating the leakage inductance of the transformer.

10. The transformer as recited in claim 9, wherein the second winding portion of the bobbin is divided into n+1 regions, wherein n is an integer from 1 to n.

11. The transformer as recited in claim 9, wherein the second winding portion of the bobbin comprises a winding chassis and a winding frame separated from the winding chassis and divided into n+1 regions, wherein n is an integer from 1 to n.

12. The transformer as recited in claim 9, wherein the bobbin comprises a pair of partition portions between each of the pair of first winding portions and the second winding portion to receive the pair of projections.

13. The transformer as recited in claim 9, wherein conductive coefficient of the first core is at least 100 times of that of the second core.

14. The transformer as recited in claim 9, wherein the first core is made of a manganese-zinc material and the second core is made of a nickel-zinc material.

15. The transformer as recited in claim 9, wherein each of the pair of first winding portions of the bobbin comprises a winding chassis and a winding frame separated from the winding chassis.

* * * * *